US007520045B2

(12) United States Patent
Lo

(10) Patent No.: US 7,520,045 B2
(45) Date of Patent: Apr. 21, 2009

(54) HEAT TREATING METHOD FOR GOLF CLUB HEAD

(75) Inventor: Lai-Fa Lo, Taoyuan (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 684 days.

(21) Appl. No.: 11/023,533

(22) Filed: Dec. 29, 2004

(65) Prior Publication Data

US 2006/0137784 A1 Jun. 29, 2006

(51) Int. Cl.
*B23P 13/04* (2006.01)
*C22F 1/16* (2006.01)

(52) U.S. Cl. ..... 29/557; 148/714

(58) Field of Classification Search ..... 29/557; 148/714, 565, 644

See application file for complete search history.

(56) References Cited

U.S. PATENT DOCUMENTS 5,879,480 A * 3/1999 Hetzner ..... 148/644
6,752,727 B2 6/2004 Harada et al.
6,776,726 B2 8/2004 Sano

* cited by examiner

*Primary Examiner*—John C Hong
(74) *Attorney, Agent, or Firm*—Muncy, Geissler, Olds & Lowe, PLLC

(57) ABSTRACT

A heat treating method for a golf club head includes preparing a golf club head having at least one heat treating zone. A protrusion is provided on the heat treating zone. Heat treatment is carried out on the protrusion by a high-energy beam, and the protrusion is removed after the heat treatment. The properties of the material of the golf club head are improved without sacrificing appearance of the golf club head.

20 Claims, 9 Drawing Sheets

HEAT TREATING METHOD FOR GOLF CLUB HEAD

BACKGROUND OF THE INVENTION

1. Field of the Invention

The present invention relates to a heat treating method. In particular, the present invention relates to a heat treating method for a golf club head.

2. Description of Related Art

Heat treating methods for a golf club head generally comprise vacuum heat treatments and high-frequency heat treatments. In a vacuum heat treatment, the whole golf club head is placed in a vacuum heat treatment furnace. Heat treatment on a particular portion of the golf club head is impossible. Further, in a case that the golf club head consists of at least two materials, the vacuum heat treatment furnace can proceed with heat treatment of only one of the materials. The properties of the other materials cannot be fully utilized. In a high-frequency heat treatment, high-frequency waves are used to proceed with local heat treatment on a particular portion of the golf club head. However, it is difficult to precisely control the temperature, the treating path, and the position of heat treatment, failing to provide uniform high-frequency heat treatments.

U.S. Pat. No. 6,776,726 discloses a golf club head comprising a ball striking face provided with a central region and a peripheral region surrounding the central region. A solution heat treatment and an aging treatment are made for the entirety of the golf club head basal body. Then, a peripheral heating treatment is made on the peripheral region by irradiating a high-energy laser beam until the surface hardness of the peripheral region is in a range of from 0.45 to 0.9 times the surface hardness of the central region. However, a portion of the surface in the heat treating zone of the peripheral region may melt and thus collapse, generating cavities, depressions, dimples, or the like during the laser treatment and adversely affecting the qualified product ratio. The irradiating time and the irradiating intensity of the high-energy beam have to be reduced to eliminate or mitigate the above problem, leading to limitation of the irradiating time, the irradiating intensity, and the depth of the heat treatment.

OBJECTS OF THE INVENTION

An object of the present invention is to provide a heat treating method for a golf club head for improving the qualified product ratio.

Another object of the present invention is to provide a heat treating method for a golf club head with treating flexibility.

A further object of the present invention is to provide a heat treating method for producing a golf club head with an improved structure for welding.

Still another object of the present invention is to provide a heat treating method for producing a golf club head allowing flexible adjustment of an angle of the hosel.

SUMMARY OF THE INVENTION

A heat treating method for a golf club head in accordance with the present invention comprises preparing a golf club head including at least one heat treating zone, providing a protrusion on the at least one heat treating zone, proceeding heat treatment on the protrusion on the at least one heat treating zone by a high-energy beam, and removing the protrusion. The properties of the material of the golf club head are improved without sacrificing appearance of the golf club head.

Preferably, the high-energy beam is laser beam, high-energy electron beam, or plasma beam.

Preferably, the high-energy beam performs aging and hardening (or tempering and softening) of a material of the heat treating zone.

In an embodiment, the golf club head body includes a striking face on which the at least one heat treating zone and the protrusion are located. The at least one heat treating zone and the protrusion are located on the sweet spot or surround a periphery of the sweet spot.

In another embodiment, the body includes a crown with a peripheral area on which the at least one heat treating zone and the protrusion are located. In a further embodiment, the at least one heat treating zone and the protrusion extend from a crown of the body to a sole of the body along a direction orthogonal to a plane on which a striking face of the golf club head lies. In still another embodiment, the at least one heat treating zone and the protrusion extend through a crown, a toe, a sole, and a heel of the body along a direction orthogonal to a plane on which a striking face of the golf club head lies. The at least one heat treating zone may be a weld seam.

In yet another embodiment, the at least one heat treating zone and the protrusion are located on a circumference of a hosel of the golf club head. Preferably, the at least one heat treating zone is a weld seam.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
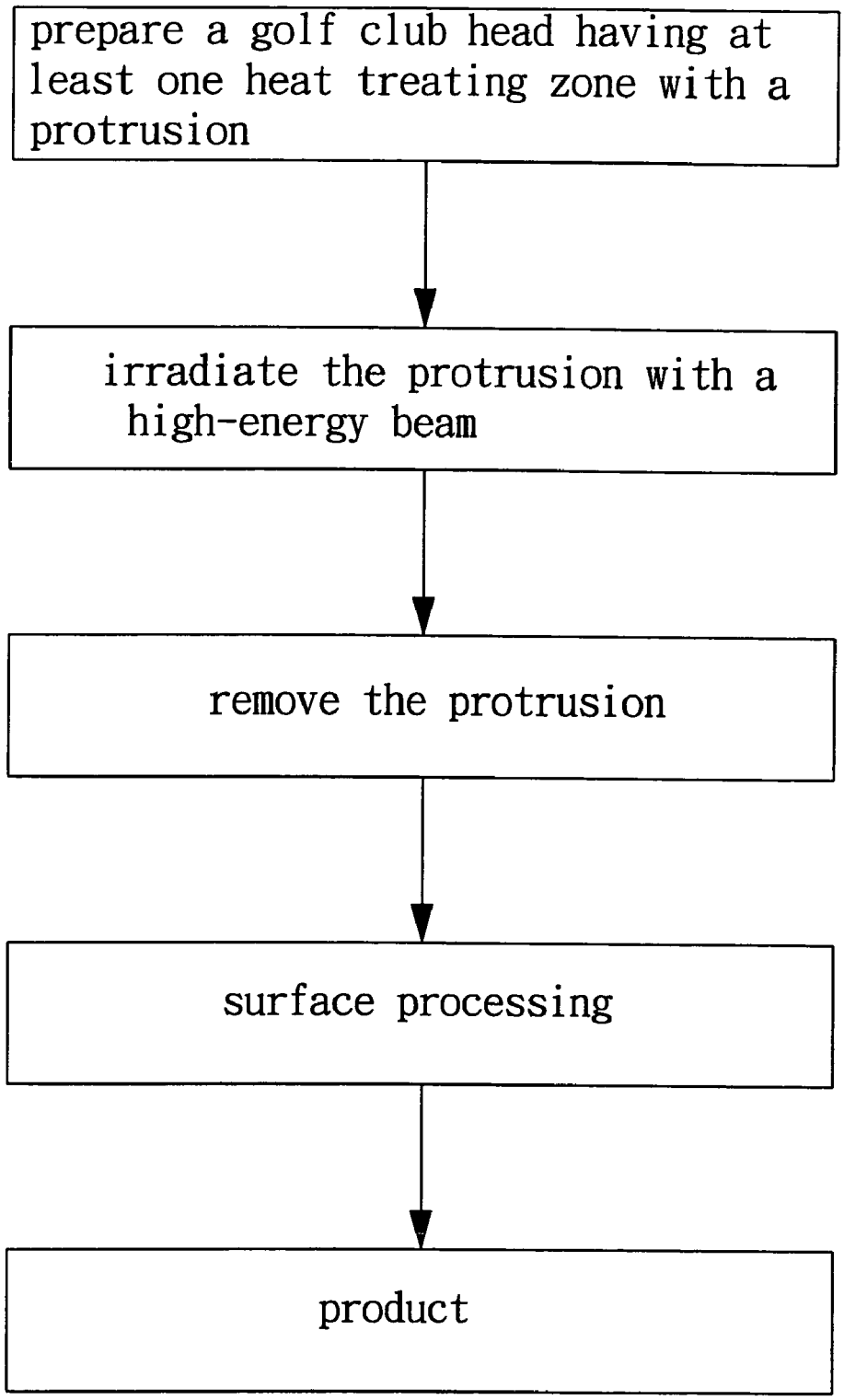
FIG. 1 is a flow chart illustrating a heat treating method for a golf club head in accordance with the present invention.
Figure 2:
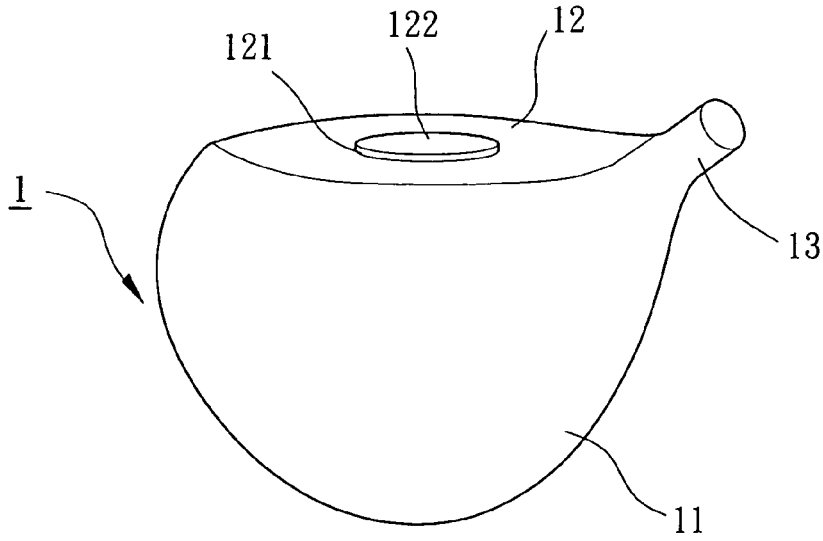
FIG. 2 is a perspective view of a golf club head of a first embodiment in accordance with the present invention.

Referring to FIGS. 1 and 2, a heat treating method for a golf club head in accordance with the present invention comprises preparing a golf club head 1 including at least one heat treating zone 121. A protrusion 122 is provided in the heat treating zone 121. The golf club head 1 is integrally formed or includes a plurality of sections that are assembled together by precision casting, forging, mechanical processing, welding, insertion fitting, adhesive, brazing, or screwing. When integrally formed, metal materials (isotropic materials) can be used for forming the golf club head 1. When made of several sections, metal materials and non-metal materials (anisotropic materials) can be combined to make the golf club head 1. The metal materials are selected from a group consisting of stainless steel (such as 14-4PH stainless steel), carbon steel, low-carbon steel, alloy steel, low-alloy steel, Fe—Mn—Al alloy, cast iron, nickel-based alloy, structural steel, supper alloy steel, or titanium alloy (such as Ti-6Al-4V). The non-metal materials are selected from a group consisting of all kinds of high molecular materials and polymer or fiber reinforced composites thereof, such as impregnated graphite fabrics and Kevlar fibers. The Kevlar fibers are poly-p-phenylene terephthalamide sold by Dupont Inc. under the name Kevlar®.

Referring to FIG. 2, the prepared the golf club head 1 comprises a body 11, a striking face 12, and a hosel 13. Heat treatment(s) is (are) carried out on the body 1, the striking face 12, and/or the hosel 13 according to need. For example, if the sweet spot (or the central area) of the striking face 12 is to be treated, the sweet spot is the heat treating zone 121, and a protrusion 122 is provided on the heat treating zone 121. The height of the protrusion 122 is correlated to the intensity of the high-energy beam.

Figure 3:
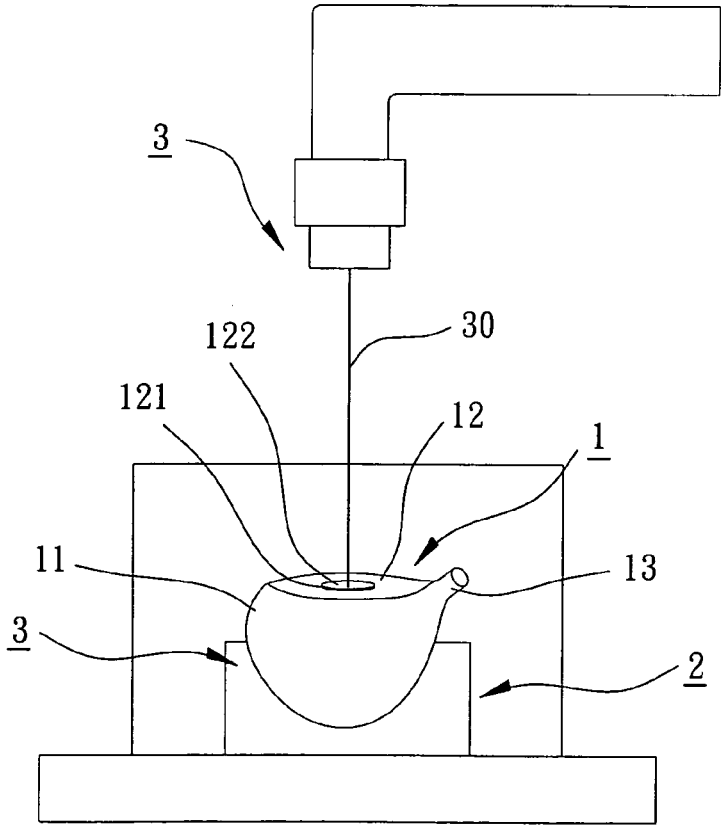
FIG. 3 is a perspective view illustrating heat treatment on the golf club head of the first embodiment in accordance with the present invention by using a high-energy beam.

Referring to FIGS. 1 and 3, a high-energy beam 30 is used to proceed with heat treatment on the protrusion 122 in the heat treating zone 121. The golf club head 1 is securely held by a clamping device 2, and a heat treating apparatus 3 generates a high-energy beam 30 (such as laser beam, electron beam, or plasma beam) to irradiate the protrusion 122. The output power, treating period, and the path of the high-energy beam 30 of the heat treating apparatus 3 can be adjusted to control the energy of the high-energy beam 30 according to the product need and the quality of the golf club head 1. In some cases, the heat treating apparatus 3 output higher power to proceed with heat treatment of the materials of the flange 122 and the heat treating zone 121, performing high-temperature aging and hardening. In other cases, the heat treating apparatus 3 output lower power to proceed heat treatment of the materials of the flange 122 and the heat treating zone 121, performing low-temperature tempering and softening.

Figure 4:
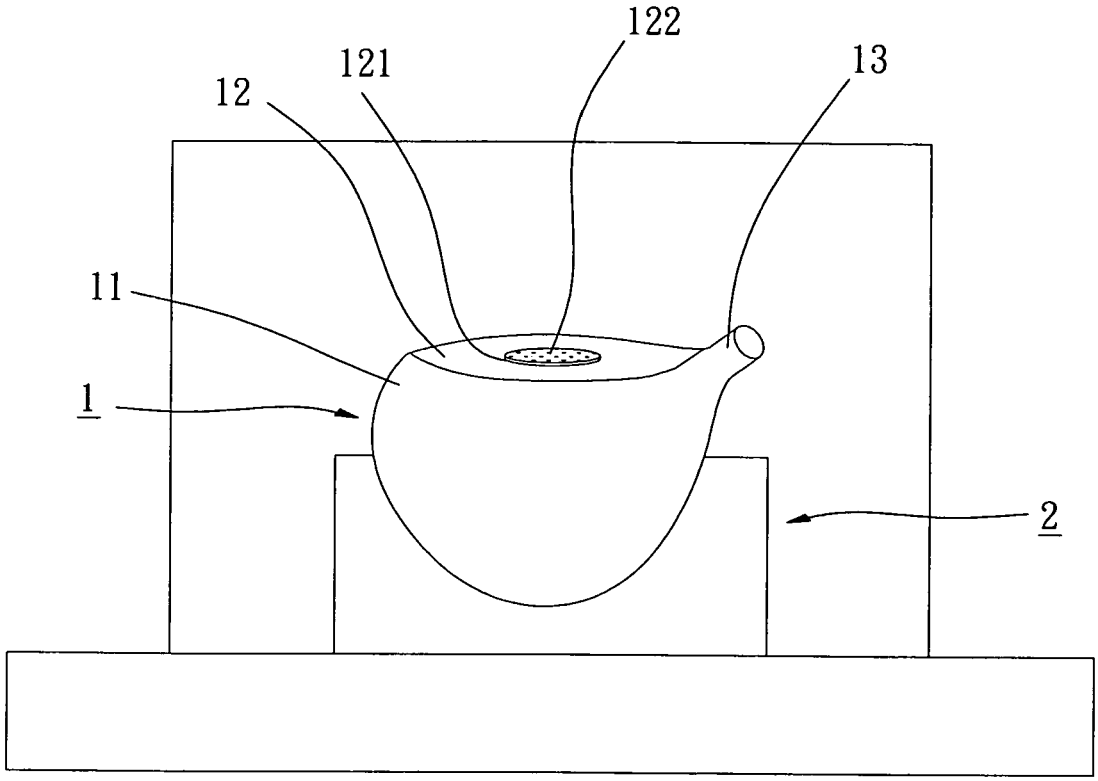
FIG. 4 is a perspective view illustrating the golf club head of the first embodiment in accordance with the present invention after heat treatment.

Referring to FIG. 4, since the high-energy beam 30 is directly incident on the surface of the protrusion 122 during the heat treatment, local melting and depression in the surface of the protrusion 122 may occur. Nevertheless, the heat energy received by the protrusion 122 is transmitted downward to the material of the heat treating zone 121 that is not directly irradiated by the high-energy beam 30. Thus, aging and hardening (or tempering and softening) of the material of the heat treating zone 121 is accomplished under the protection of the protrusion 122. As a result, the structure of the material of the heat treating zone 121 remains intact. After heat treatment by the high-energy beam 30, the hardness of the material of the heat treating zone 121 reaches the predetermined value, increasing the coefficient of restitution, improving durability of the golf club head, and/or allowing flexible adjustment in the angle of the hosel 13.

Figure 5:
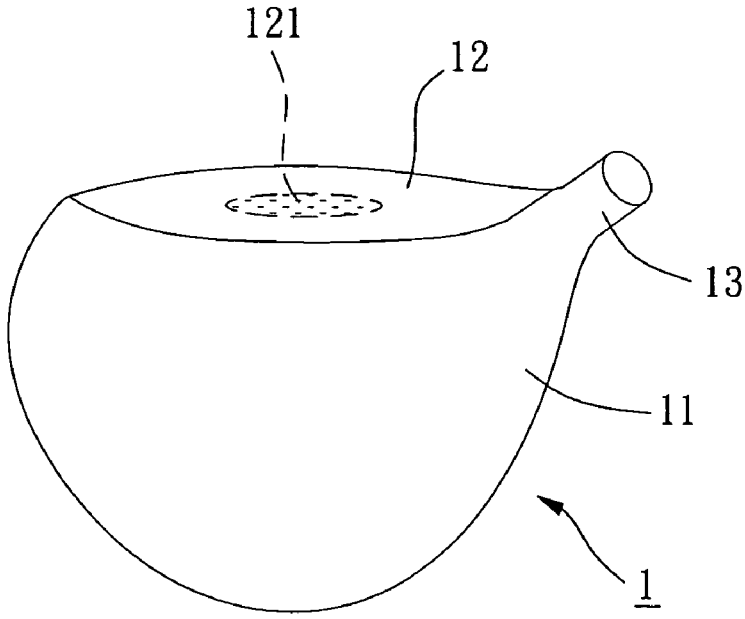
FIG. 5 is a perspective view illustrating the golf club head of the first embodiment in accordance with the present invention after surface finishing.

Next, the protrusion 122 is removed by e.g., grinding as shown in FIGS. 1 and 5. The surface of the striking face 12 can be polished by grinding, mechanic milling, vibrational grinding/polishing, electrolytic polishing, or chemical polishing. The protrusion 122 on the heat treating zone 121 is thus removed, leaving exposed surface of the heat treating zone 121 with desired coarseness. After grinding, the heat treating zone 121 is not visually distinct to the remaining area of the striking face 122.

Figure 6:
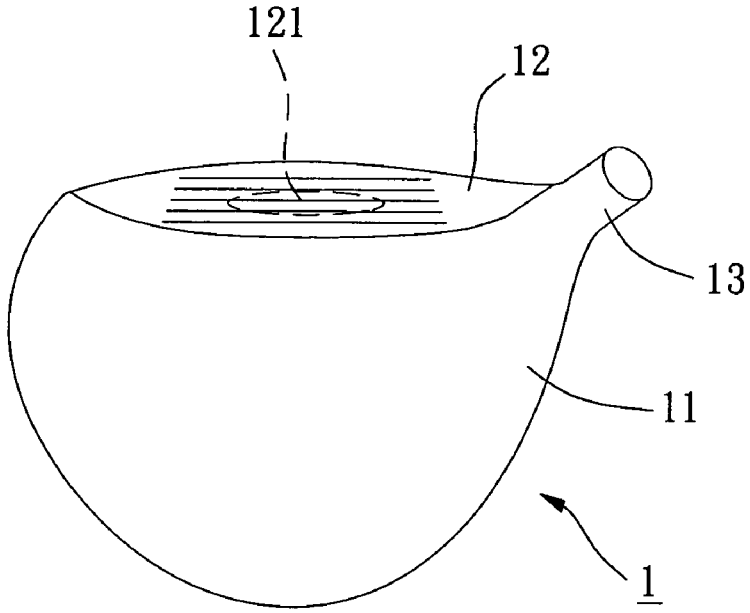
FIG. 6 is a perspective view illustrating a final product of the golf club head of the first embodiment in accordance with the present invention.

Referring to FIGS. 1 and 6, surface processing is then carried out on the golf club head 1 to obtain a golf club head product. After removal of the protrusion 122, deburring, removal of residual material, derusting, adjustment in the angle of the hosel 13, electroplating, ionized evaporation, painting, mirror finishing, satin finishing, mechanic carving, laser carving, shot peening, printing of patterns or trademarks, protective painting, bonding of protective film, etc can be carried out according to the product need. Golf club head products with improved appearance and uniform specification are thus provided.

Figure 7:
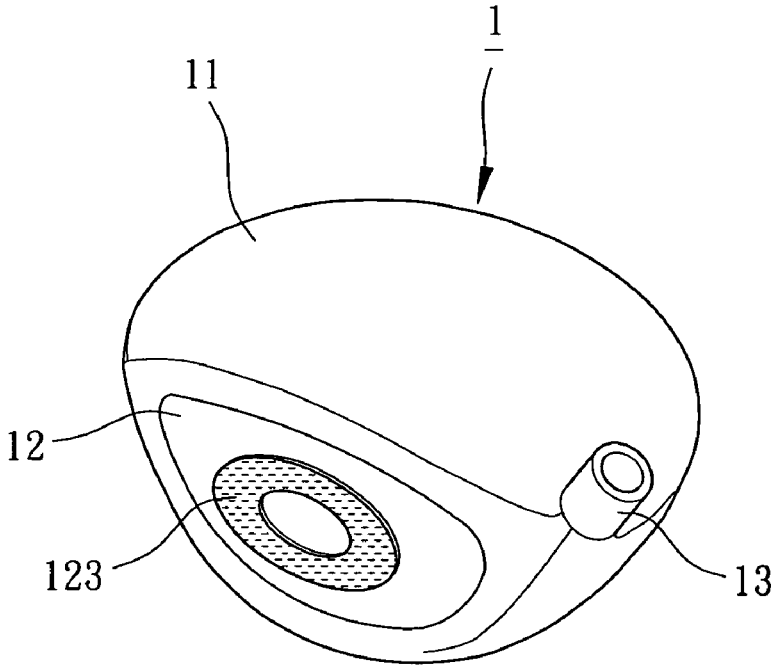
FIG. 7 is a perspective view of a golf club head of a second embodiment in accordance with the present invention after heat treatment.

FIG. 7 illustrates a second embodiment of the invention, wherein an annular protrusion 123 is provided and surrounds a periphery of the sweet spot of the striking face 12. Referring to FIG. 1, the annular protrusion 123 is treated by a high-energy beam 30 for aging and hardening (or tempering and softening). The annular protrusion 123 is then grinded and polished, providing the periphery of the sweet spot of the striking face 12 with desired elastic deformability.

Figure 8:
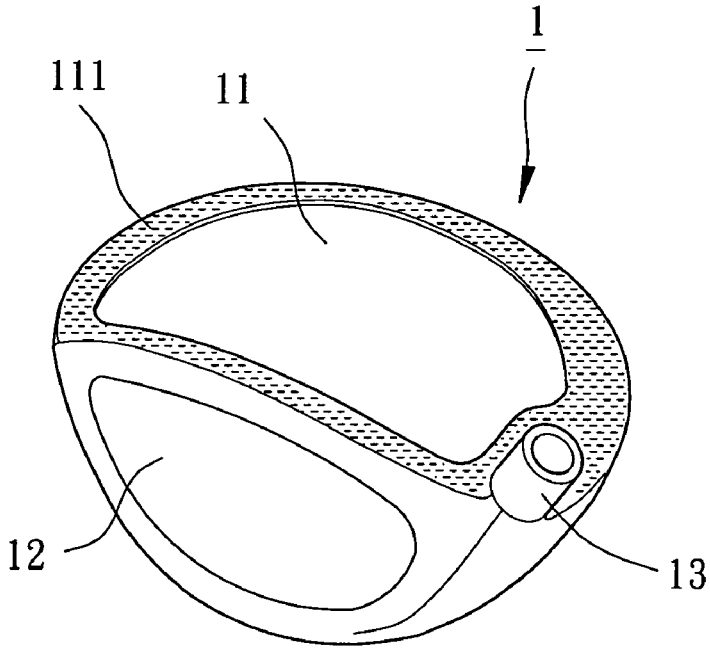
FIG. 8 is perspective view of a golf club head of a third embodiment in accordance with the present invention after heat treatment.

FIG. 8 illustrates a third embodiment of the invention, wherein a protrusion 111 is provided along a peripheral area of a crown of the body 11. Referring to FIG. 1, the protrusion 111 is treated by a high-energy beam 30 for aging and hardening (or tempering and softening), eliminating the problems of coarseness of the crystalline grains and non-homogeneity of the material. The protrusion 111 is then grinded and polished. Thus, the peripheral area of crown of the body 11 has improved elastic deformability, improved bonding strength for welding, and improved extensibility.

Figure 9:
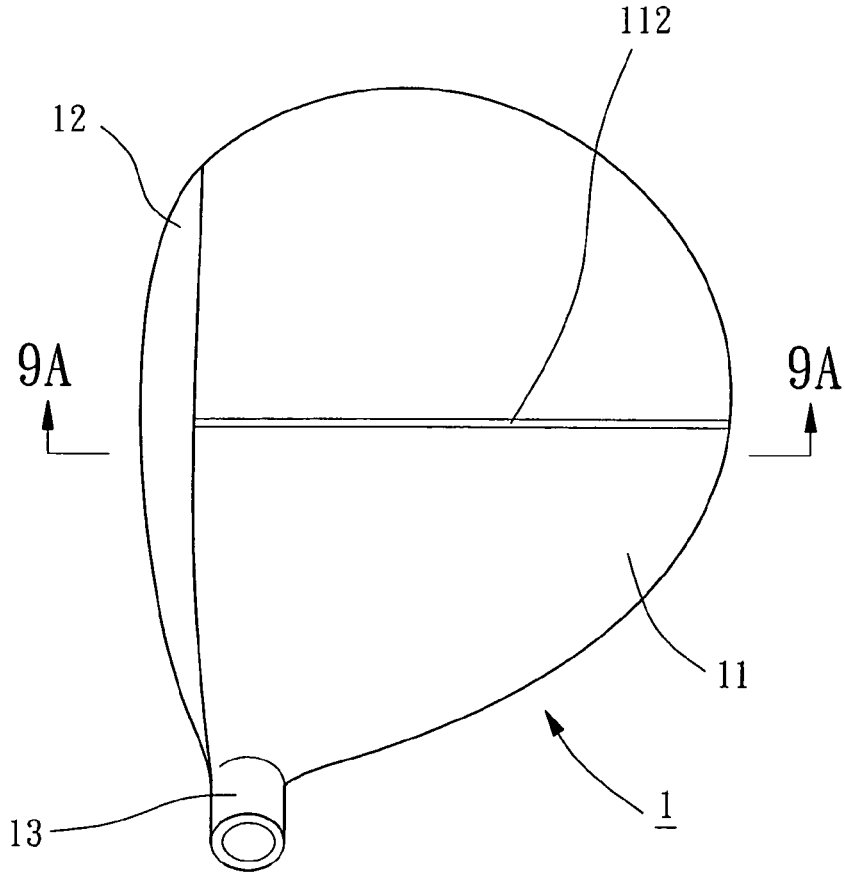
FIG. 9 is a perspective view of a golf club head of a fourth embodiment in accordance with the present invention after heat treatment.
Figure 9A:
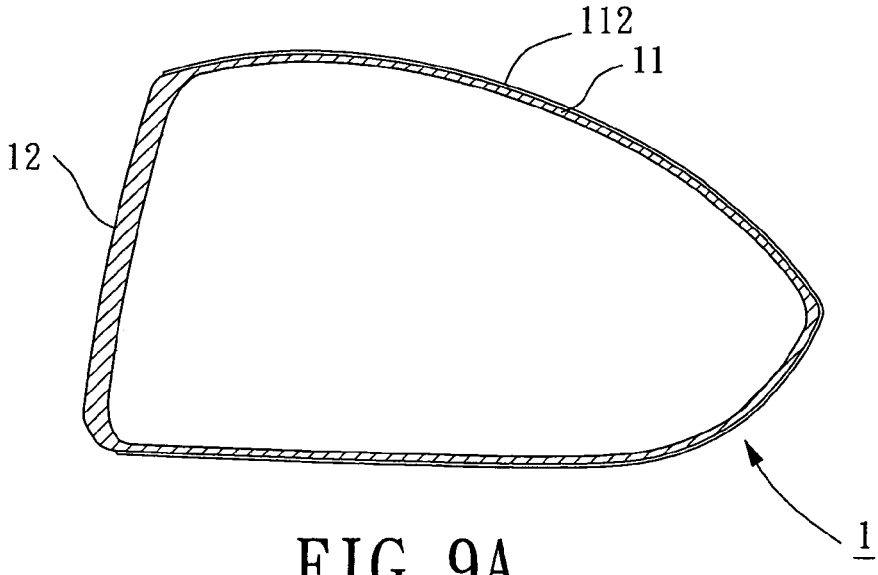
FIG. 9A is a sectional view taken along line 9A-9A in FIG. 9.
Figure 10:
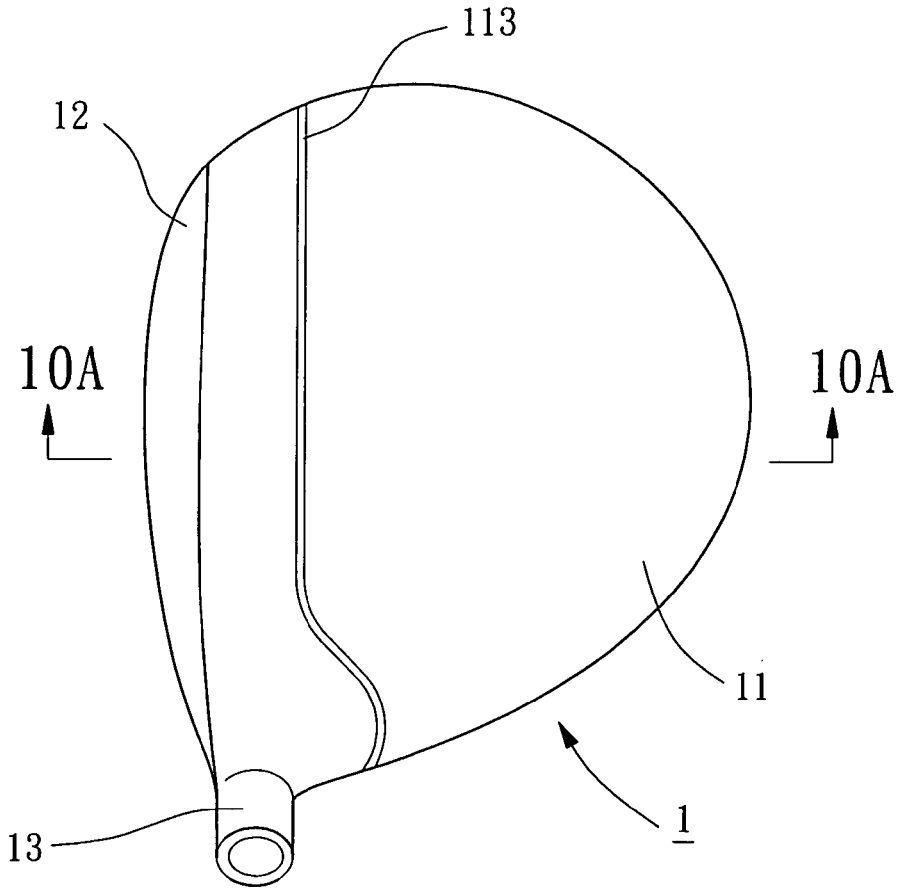
FIG. 10 is a perspective view of a golf club head of a fifth embodiment in accordance with the present invention after heat treatment.
Figure 10A:
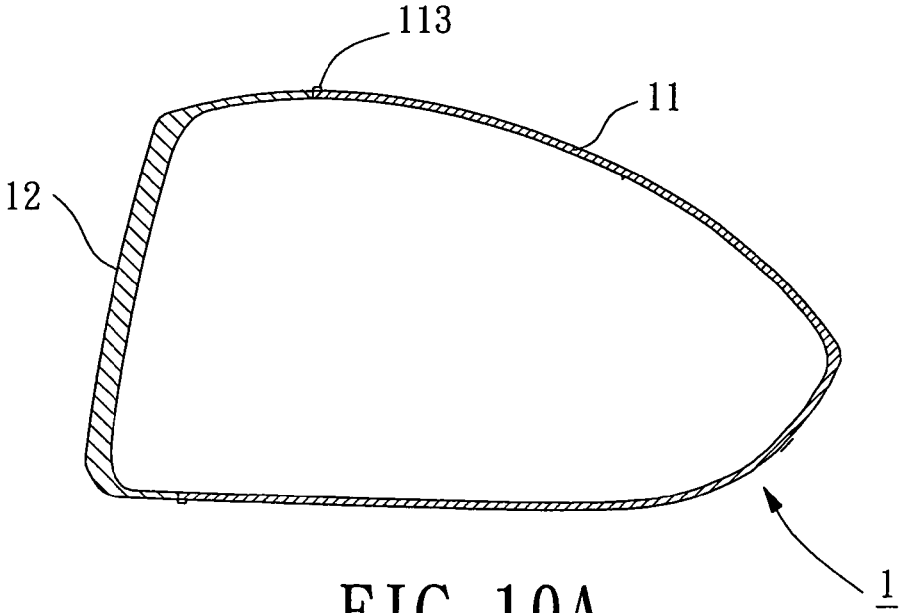
FIG. 10A is a sectional view taken along line 10A-10A in FIG. 10.

FIGS. 9 and 9A illustrate a fourth embodiment of the invention, wherein the protrusion 112 extends from the crown to the sole. Preferably, the protrusion 112 extends along a weld seam. Preferably, the protrusion 112 extends along a direction orthogonal to a plane on which the striking face 12 lies. FIGS. 10 and 10A illustrate a fifth embodiment of the invention, wherein the protrusion 113 extends through the crown, toe, sole, and heel of the body 1. Preferably, the protrusion 113 extends along a weld seam. Preferably, the protrusion 113 extends along a direction orthogonal to a plane on which the striking face 12 lies. Similar to the above embodiment, the elastic deformability, the bonding strength for welding, and the extensibility can be improved through heat treatment of the protrusions 112 and 113.

Figure 11:
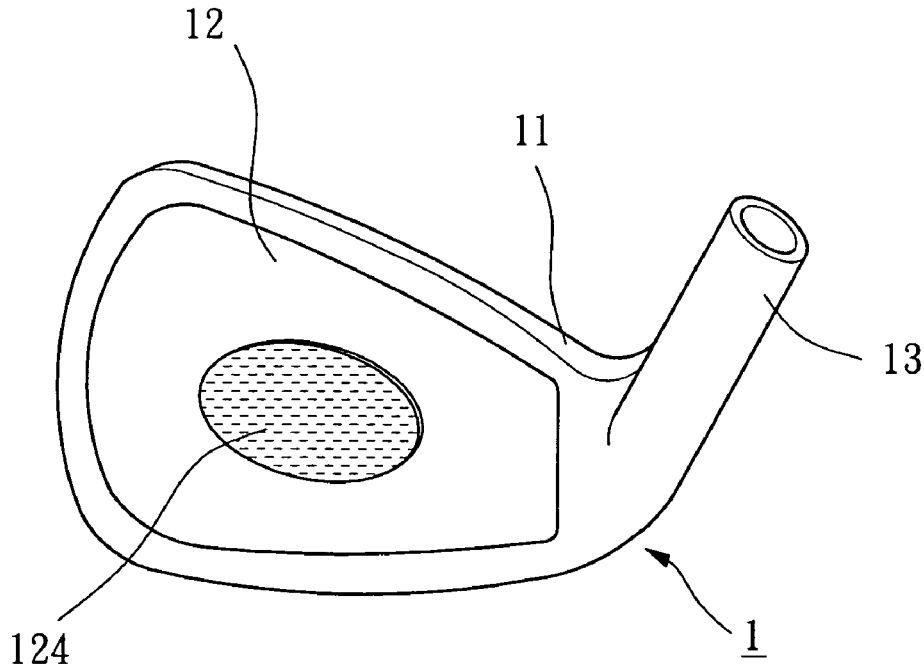
FIG. 11 is a perspective view of a golf club head of a sixth embodiment in accordance with the present invention after heat treatment.
Figure 12:
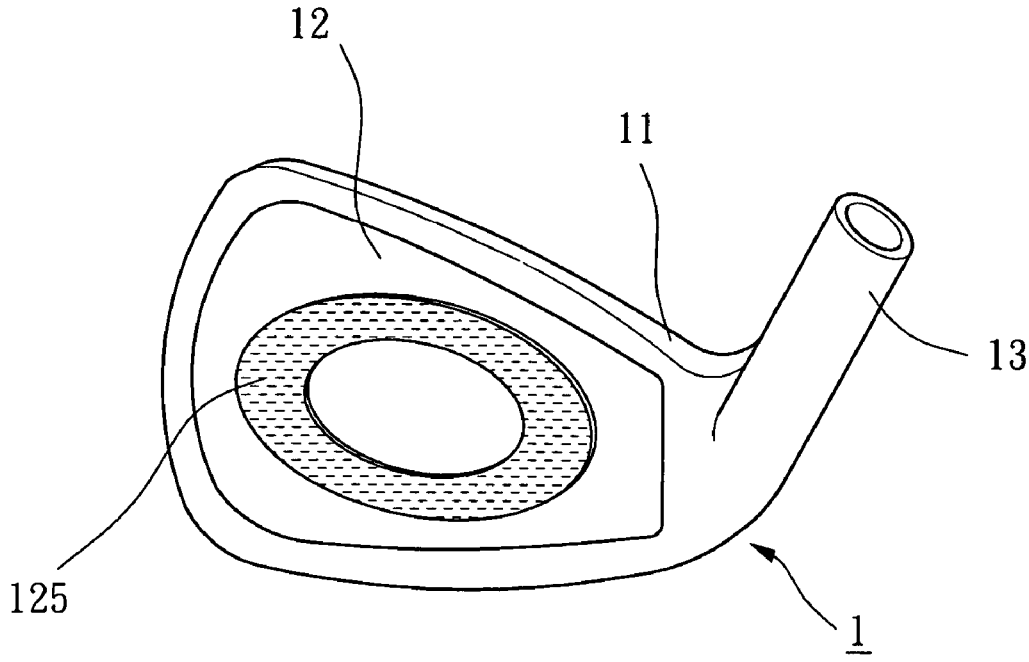
FIG. 12 is a perspective view of a golf club head of a seventh embodiment in accordance with the present invention after heat treatment.
Figure 13:
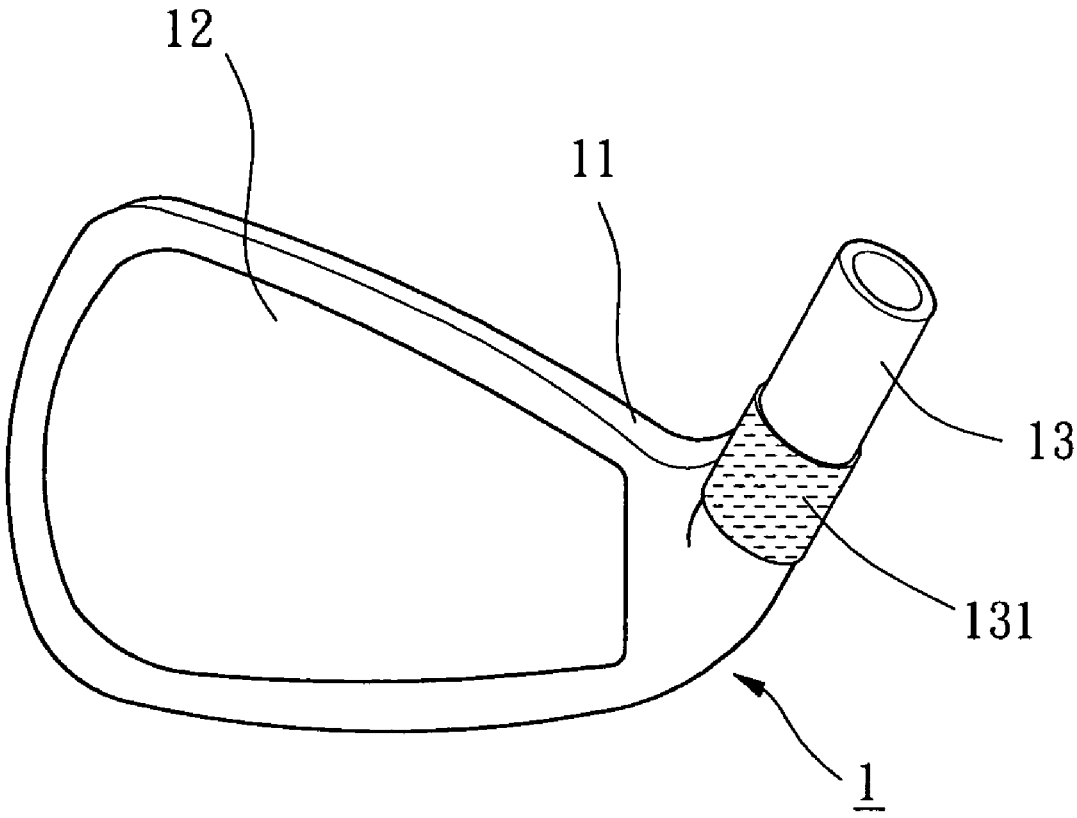
FIG. 13 is a perspective view of a golf club head of an eight embodiment in accordance with the present invention after heat treatment.

FIG. 11 illustrates a sixth embodiment of the invention, wherein the body 1 is of iron club type and a protrusion 124 is provided on the sweet spot of the striking face 12. The elastic deformability of the sweet spot is improved after heat treatment. FIG. 12 illustrates a seventh embodiment of the invention, wherein the body 1 is of iron club type and an annular protrusion 125 is provided and surrounds a periphery of the sweet spot of the striking face 12. The elastic deformability of the periphery of the sweet spot is improved after heat treatment. FIG. 13 illustrates an eight embodiment of the invention, wherein the body 1 is of iron club type and a protrusion 131 is provided on a portion of a circumference of the hosel 13. The bonding strength for welding and/or extensibility of the hosel 13 is(are) improved after heat treatment, allowing flexible adjustment of the angel of the hosel 13.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat treating method for a golf club head, comprising:

preparing a golf club head including a striking face having a sweet spot and at least one heat treating zone located on the sweet spot;

providing a protrusion on said at least one heat treating zone;

proceeding heat treatment on the protrusion on said at least one heat treating zone by a high-energy beam; and removing the protrusion.

2. The heat treating method as claimed in claim 1 wherein the high-energy beam is one of laser beam, high-energy electron beam, and plasma beam.

3. The heat treating method as claimed in claim 1 wherein the high-energy beam performs aging and hardening of a material of the heat treating zone.

4. The heat treating method as claimed in claim I wherein the high-energy beam performs tempering and softening of the heat treating zone.

5. The heat treating method as claimed in claim 1 wherein the golf club head includes a body on which said at least one heat treating zone and the protrusion are located.

6. The heat treating method as claimed in claim 5 wherein the body includes a crown with a peripheral area on which said at least one heat treating zone and the protrusion are located.

7. The heat treating method as claimed in claim 5 wherein said at least one heat treating zone and the protrusion extend from a crown of the body to a sole of the body along a direction orthogonal to a plane on which a striking face of the golf club head lies.

8. The heat treating method as claimed in claim 5 wherein said at least one heat treating zone and the protrusion extend through a crown, a toe, a sole, and a heel of the body along a direction orthogonal to a plane on which a striking face of the golf club head lies.

9. The heat treating method as claimed in claim 5 wherein said at least one heat treating zone is a weld seam.

10. The heat treating method as claimed in claim 1 wherein the golf club head includes a hosel having a circumference on which said at least one heat treating zone and the protrusion are located.

11. The heat treating method as claimed in claim 10 wherein said at least one heat treating zone is a weld seam.

12. A heat treating method for a golf club head, comprising:

preparing a golf club head including a striking face having a sweet spot with a periphery and at least one heat treating zone surrounding the periphery of the sweet spot;

providing a protrusion on said at least one heat treating zone;

proceeding heat treatment on the protrusion on said at least one heat treating zone by a high-energy beam: and removing the protrusion.

13. The heat treating method as claimed in claim 12 wherein the golf club head includes a body on which said at least one heat treating zone and the protrusion are located.

14. The heat treating method as claimed in claim 13 wherein the body includes a crown with a peripheral area on which said at least one heat treating zone and the protrusion are located.

15. The heat treating method as claimed in claim 13 wherein said at least one heat treating zone and the protrusion extend from a crown of the body to a sole of the body along a direction orthogonal to a plane on which a striking face of the golf club head lies.

16. The heat treating method as claimed in claim 13 wherein said at least one heat treating zone and the protrusion extend through a crown, a toe, a sole, and a heel of the body along a direction orthogonal to a plane on which a striking face of the golf club head lies.

17. The heat treating method as claimed in claim 13 wherein said at least one heat treating zone is a weld seam.

18. The heat treating method as claimed in claim 12 wherein the golf club head includes a hosel having a circumference on which said at least one heat treating zone and the protrusion are located.

19. The heat treating method as claimed in claim 18 wherein said at least one heat treating zone is a weld seam.

20. A heat treating method for a golf club head, comprising:

preparing a golf club head including a body having a crown with a peripheral area and at least one heat treating zone located on the peripheral area;

providing a protrusion on said at least one heat treating zone;

proceeding heat treatment on the protrusion on said at least one heat treating zone by a high-energy beam; and removing the protrusion.

* * * * *